United States Patent [19]

Shook

[11] 4,243,107

[45] Jan. 6, 1981

[54] HYDRAULIC HAMMER MOUNTED ON A MOVABLE BOOM

[75] Inventor: William M. Shook, New Philadelphia, Ohio

[73] Assignee: The Warner & Swasey Company, Cleveland, Ohio

[21] Appl. No.: 6,136

[22] Filed: Jan. 24, 1979

[51] Int. Cl.[3] ..... E21C 5/00

[52] U.S. Cl. ..... 173/43; 60/419; 60/429; 299/70

[58] Field of Search ..... 173/27, 28, 43, 44; 15/104.07; 299/70; 60/419, 428, 429

[56] References Cited

U.S. PATENT DOCUMENTS

| | | | |
|---|---|---|---|
| 1,795,108 | 3/1931 | Degenhardt et al. | 299/70 |
| 2,983,496 | 5/1961 | Grant | 173/43 X |
| 3,090,983 | 5/1963 | Modrak et al. | 173/43 X |
| 3,460,691 | 8/1969 | Wieger et al. | 173/28 X |

*Primary Examiner*—Wm. Carter Reynolds
*Attorney, Agent, or Firm*—Howard G. Massung

[57] ABSTRACT

An improved arrangement for operating a hydraulic hammer at a distance from the hydraulic supply. The hydraulic hammer which can be used for breaking rocks, concrete, and the like is disposed at the end of a movable boom, remote from its pressurized hydraulic supply. The hammer is connected to the pressurized hydraulic supply by flexible lines and is movable with respect to the pressurized supply. Disposed in series in the pressurized hydraulic supply line is a hydraulic motor. The hydraulic motor is mounted in close proximity to the hydraulic hammer at the end of the boom. The outlet port of the hydraulic motor connects to the inlet port of the hydraulic hammer. The hydraulic motor drives a suction pump which is also located at the end of the positionable boom. The hydraulic motor and the suction pump are movable with a mounting assembly which supports the hydraulic hammer at the end of the boom. The suction inlet of the hydraulic pump is directly connected to the outlet port of the hydraulic hammer. The back pressure at the outlet port of the hydraulic hammer is thus completely eliminated. The hydraulic pump forces the operating hydraulic fluid along a return line to a sump. The disclosed arrangement improves the operation of the hydraulic hammer and reduces the size of the required hydraulic return lines.

9 Claims, 4 Drawing Figures

HYDRAULIC HAMMER MOUNTED ON A MOVABLE BOOM

BACKGROUND OF THE INVENTION

1. Field of the Invention

This invention relates to hydraulic hammers and more particularly to a hydraulic circuit for improving operation of a hydraulic hammer mounted remote from the hydraulic supply.

2. Description of the Prior Art

Fluid operated hammers have for a relatively long time been used at the end of a movable boom on various machines. See for example U.S. Pat. No. 2,983,496 issued May 9, 1961. The hammers have an inlet port for receiving the operating fluid and an outlet port from which the fluid is expelled. These hammers which are used for breaking rock, concrete, and the like are adversely affected by back pressure on the outlet port.

Originally, these hammers were pneumatically operated and the outlet port could vent directly to atmosphere. In pneumatic hammers, since the outlet was directly vented to atmosphere, back pressure did not inhibit operation. The operating fluid for the hammer can also be hydraulic. For hydraulically operated hammers the hydraulic fluid cannot be discharged at the outlet port of the hammer but must be returned to a hydraulic supply sump.

Since back pressure at the hydraulic hammer outlet port can adversely affect hammer operation, the return hydraulic lines were required to be of a relatively large size to minimize back pressure. However, since the hydraulic sump is located a substantial distance from the hammer itself, even a relatively large return line provides enough restriction to hydraulic fluid flow so as to cause appreciable back pressure at the outlet port.

It has been recognized that this back pressure problem at the outlet port is a problem with hydraulic hammer operation. Attempts have been made to solve this problem by providing a suction pump at the hydraulic supply sump to more effectively draw the hydraulic fluid through the return line. This approach, however, has not been completely effective and a rather large hydraulic return line from the hydraulic hammer is still required.

SUMMARY OF THE INVENTION

An improved operating arrangement is provided for a hydraulic hammer which is mounted remote from its high pressure hydraulic supply. In the disclosed invention back pressure reducing apparatus is provided in close proximity to the hydraulic hammer. The back pressure reducing apparatus is operated by the high pressure hydraulic supply line and provides a suction at the hydraulic hammer outlet port to eliminate back pressure. The apparatus is provided in close proximity to the hydraulic hammer and is movable with the mounting device which supports the hydraulic hammer. As the hydraulic hammer is moved with respect to the high pressure hydraulic supply the back pressure reducing apparatus is also moved.

The back pressure reducing apparatus which is mounted in close proximity to the hydraulic hammer is a motor and pump arrangement. The motor, which is hydraulic, is driven by the hydraulic fluid supplied to the hammer. The motor can be disposed in series with the pressurized hydraulic supply line. The outlet port of the hydraulic motor is connected to the inlet port of the hydraulic hammer. There is a slight pressure drop across the hydraulic motor, however, this does not significantly affect performance of the hydraulic hammer. The hydraulic motor drives a pump whose suction side is connected to the outlet port of the hydraulic hammer. The pump eliminates back pressure at the outlet port of the hydraulic hammer. The outlet of the pump feeds the hydraulic return line which returns the hydraulic fluid to the hydraulic sump. The hydraulic return line can be of a relatively small size since the hydraulic fluid is pumped therethrough. The hydraulic return line need only be large enough to accept the fluid flow from the remote operated back pressure reducing pump.

It is an object of this invention to teach a simple motor pump arrangement which can be provided in close proximity to a hydraulic hammer to significantly improve operation thereof.

It is a further object of this invention to teach back pressure reducing apparatus which is operated by the hydraulic fluid supplied to a hydraulic hammer for reducing the back pressure at the outlet port of the hydraulic hammer.

BRIEF DESCRIPTION OF THE DRAWINGS

For a better understanding of the invention reference may be had to the preferred embodiment of the invention shown in the accompanying drawings in which.

DESCRIPTION OF THE PREFERRED EMBODIMENT

Figure 1:
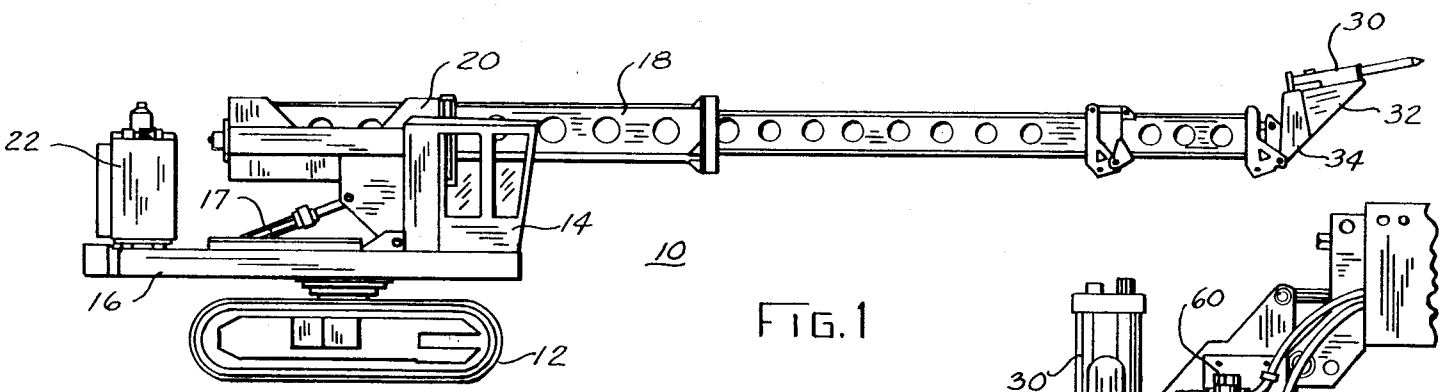
FIG. 1 is a side view of a hydraulic excavator having a hydraulic hammer mounted at the end of an extendable boom.
Figure 4:
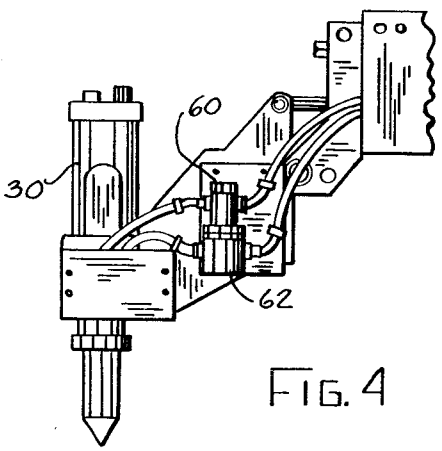
FIG. 4 shows the hydraulic pump and motor mounted on the hydraulic hammer support bracket.

Although it is contemplated that the present invention may be used in different areas, it is disclosed here for use on a well known type of hydraulic excavator vehicle 10. Driven tracks 12 are provided for moving the vehicle 10. An operator cab or station 14 includes the control for operating vehicle 10. A vehicle 10 of the type which is suitable for utilizing hydraulic hammers according to the present invention is more fully disclosed in the following U.S. Pat. Nos.: (1) 2,684,159 and (2) 2,984,373 whose teachings are hereby incorporated by reference.

On vehicle 10 platform 16 is rotatably supported with respect to track assembly 12. A boom assembly 18 which is extendable and retractable is supported from platform 16. Boom assembly 18 is supported for rotation about its longitudinal axis by a carriage 20. Carriage 20 is pivotally mounted to platform 16 and it can be positioned up and down by hydraulic operating cylinders 17. Vehicle 10 thus provides a great deal of versatility for positioning the hydraulic hammer supporting boom 18 in a desired position.

The hydraulic hammer 30 is mounted at the end of hollow boom 18 on a support assembly 32. Support assembly 32 is mounted for pivotal movement about a connection 34 to boom 18. A hydraulic cylinder (not shown) is connected to support assembly 32 to position hydraulic hammer 30 with respect to the end of boom 18.

An auxiliary engine 22 is mounted on rotatable platform 16 and provides power for operating the hydraulic system of vehicle 10.

Figure 2:
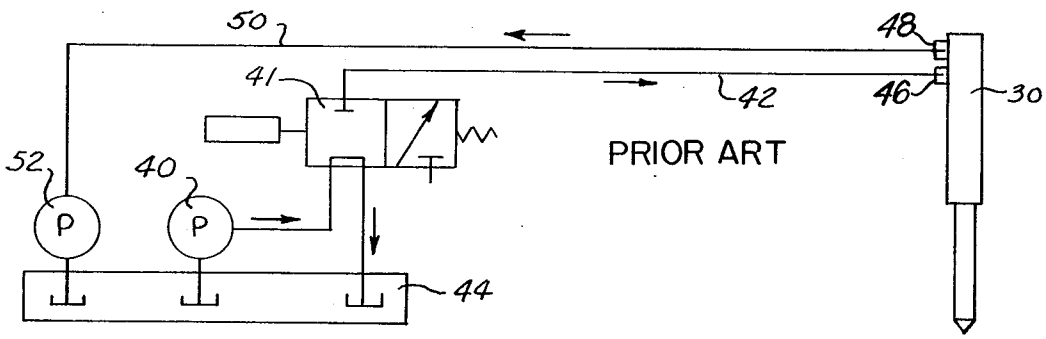
FIG. 2 is a prior art hydraulic circuit for operating a hydraulic hammer at the end of the hydraulic boom.

Referring now to FIG. 2, there is shown a prior art hydraulic circuit for operating hydraulic hammer 30. A pump 40 is provided for supplying high pressure hydraulic fluid to hammer 30. A control valve 41 is provided at the output side of pump 40 for connecting the hydraulic output to a hydraulic supply line 42. Valve 41 is solenoid operated and is spring biased to a venting position. Valve 41 can be electrically operated. Alternately, valve 41 can be a mechanical hand operated valve or a valve operated by hydraulic or pneumatic fluid. When valve 41 is in the venting position shown in FIG. 2, hydraulic fluid is not supplied to hammer 30, rather it is fed back into hydraulic supply sump 44. When solenoid valve 41 is energized, the pressurized output of pump 40 is connected to supply line 42 and supplies pressurized hydraulic fluid to the inlet port 46 of hydraulic hammer 30. Hydraulic hammer 30 can be of various types and an exemplary hammer is Model 514 manufactured by Joy Mfg. Co.

Hydraulic hammer 30 includes an inlet port 46 and an outlet port 48. Hydraulic fluid under pressure is supplied in inlet port 46 and vented from outlet port 48. Outlet port 48 connects to a hydraulic return line 50. Hydraulic hammer 30 is particularly susceptible to being influenced by back pressure at outlet port 48. Any back pressure at outlet port 48 adversely affects operation of air hammer 30. To prevent substantial back pressure fairly large return lines 50 have been used in the prior art. Another prior art method of attempting to reduce back pressure at port 48 has been to provide a pump 52, located at hydraulic sump 44, to provide a suction on return line 50. This approach has not proven completely effective in removing the back pressure at outlet port 48. In an attempt to reduce hammer back pressure, oversized hydraulic return lines 50 have also been used. Their larger sizes prevent them from being supported within boom 18 as is desirable. Rather, the oversized hydraulic return lines must be run along the outside of boom 18.

Figure 3:
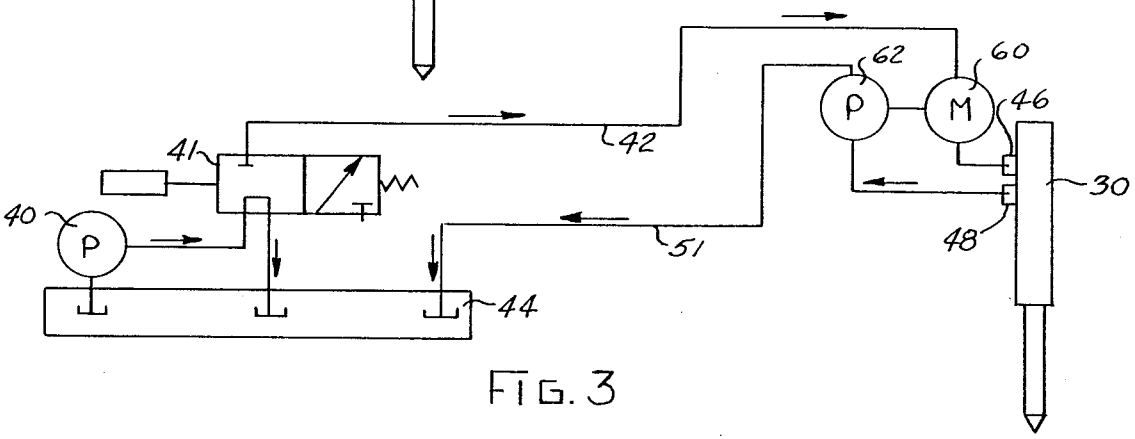
FIG. 3 is the hydraulic circuit according to the teaching of the present invention for operating the hydraulic hammer at the end of the excavator boom.

Referring now to FIG. 3, there is shown a hydraulic circuit according to the teaching of the present invention, for operating hammer 30. Pump 40 supplies high pressure hydraulic fluid for operating hammer 30. Solenoid valve 41 as described above is responsive to an operator in cab 14 and controls the flow of hydraulic fluid 14 through hydraulic supply line 42 to hammer 30. A hydraulic motor 60 is disposed in series in hydraulic supply line 42. Hydraulic motor 60 is Model No. P-50M manufactured by Commercial Shearing Co. The outlet port of motor 60 is connected to the inlet port 46 of hydraulic hammer 30. There is a slight pressure drop across motor 60, however, it does not significantly affect the performance of hydraulic hammer 30. If desired, the pressure of the fluid supplied by pump 40 through line 42 can be increased to compensate for any pressure drop across motor 60.

The mechanical output of motor 60 is connected to drive pump 62. The suction inlet of pump 62 is connected to the outlet port 48 of hydraulic hammer 30. Pump 62 is Model No. P-75 manufactured by Commercial Shearing Co. Pump 62 eliminates back pressure at the outlet port of hydraulic hammer 30. The outlet of pump 62 feeds return line 51. Pumping the return operating fluid back to sump 44 permits a much smaller return line to be used than is required in prior art systems.

In the disclosed system having pump 62 mounted at the boom end in close proximity to hydraulic hammer 30 the size of the return line is $1\frac{1}{4}''$. For a prior art system, a larger diameter return hose 50 is required. The oversized return lines required in the prior art were mounted on the exterior of boom 18. The smaller return line 51, which can be utilized since the the hydraulic fluid is pumped back to sump 44 can be mounted inside of hollow boom 18.

Pump 62 and motor 60 are mounted on bracket 32 in close proximity to hydraulic hammer 30. Hydraulic hammer 30, pump 62, and motor 60 are movable as a unit with respect to hydraulic supply pump 40.

I claim:

1. A machine comprising:

a platform;

an extendable boom supported from said platform;

a hydraulic hammer supported at the movable end of said extendable boom having an inlet port for receiving operating hydraulic fluid and an outlet for venting hydraulic fluid;

a hydraulic sump disposed on said platform;

a supply pump supplying pressurized hydraulic fluid for operating said hammer;

a suppy line connecting the output of said supply pump to said hydraulic hammer;

a return line connecting to the outlet of said hydraulic hammer to the hydraulic sump; and a back pressure reducing pump in close proximity to the hydraulic hammer at the end of said extendable boom, connected in the return line and having its suction inlet connected to the outlet of said hydraulic hammer to pump the hydraulic fluid through the return line.

2. A machine as claimed in claim 1 comprising:

a support assembly connected to the end of said extendable boom;

said hammer connected to said support assembly and, said back pressure reducing pump connected to said support assembly for unitary movement with said hydraulic hammer.

3. A machine as claimed in claim 1 comprising:

a hydraulic motor, having an inlet and an outlet, disposed in series with said supply line in close proximity to said hydraulic hammer;

the inlet of said hydraulic hammer connected to the outlet of said hydraulic motor; and, the mechanical output of said hydraulic motor connected to drive said back pressure reducing pump.

4. A machine as claimed in claim 3 wherein:

said extendable boom is hollow;

said supply line and said return line are disposed within said hollow extendable boom.

5. A machine as claimed in claim 4 comprising:

a control valve disposed in said supply line for connecting or interrupting the pressurized hydraulic fluid from the output of said supply pump to said hydraulic hammer.

6. A hydraulic circuit for operating a hydraulic hammer which has an inlet port and an outlet port, said hydraulic circuit comprises:

a hydraulic sump;

a supply pump for supplying pressurized hydraulic fluid from said hydraulic sump to a remote mounted hydraulic hammer;

a hydraulic supply line connecting said supply pump to the inlet port of said hydraulic hammer;

a hydraulic motor disposed in series in said hydraulic supply line in close proximity to said hydraulic hammer;

a hydraulic return line connecting the outlet port of said hydraulic hammer to said hydraulic sump;

a return pump connected in series in said hydraulic return line and being driven by said hydraulic motor.

7. A hydraulic circuit as claimed in claim 6 wherein said pump is disposed in close proximity to said hydraulic hammer and directly connected to the hydraulic hammer outlet port.

8. A hydraulic circuit as claimed in claim 7 wherein a support assembly is provided which supports said hydraulic hammer, said hydraulic motor, and said return pump for unitary movement.

9. A machine comprising:

a platform;

a movable boom supported from said platform;

a hydraulic hammer, having an inlet and an outlet, mounted at the end of said movable boom;

a hydraulic supply means located on said platform providing pressurized hydraulic fluid for operating said hydraulic hammer;

a hydraulic sump providing hydraulic fluid for said hydraulic supply means;

hydraulic supply line means for connecting said hydraulic supply to said hydraulic hammer inlet;

hydraulic return line means for connecting said hydraulic hammer outlet to said hydraulic sump;

a hydraulic motor disposed at the end of said movable boom and being operated by pressurized hydraulic fluid from said hydraulic supply;

a hydraulic pump driven by said hydraulic motor, disposed at the end of said boom having its inlet connected to the outlet of said hydraulic hammer to pump hydraulic fluid through said hydraulic return line means.

* * * * *